United States Patent [19]

van der Wielen

[11] 4,409,881

[45] Oct. 18, 1983

[54] COMPOSITE BARREL AND PROCESS FOR THE MANUFACTURE THEREOF

[75] Inventor: Pierre van der Wielen, Liege, Belgium

[73] Assignee: Fabrique Nationale Herstal, Herstal, Belgium

[21] Appl. No.: 182,936

[22] Filed: Sep. 2, 1980

[30] Foreign Application Priority Data

Sep. 26, 1979 [BE] Belgium ..... 2/58100

[51] Int. Cl.[3] ..... F41C 21/02

[52] U.S. Cl. ..... 89/16; 428/667

[58] Field of Search ..... 42/76 R, 76 A; 89/14 R, 89/16; 428/627, 665, 667, 679

[56] References Cited

U.S. PATENT DOCUMENTS 464,978 12/1891 Mannesmann ..... 89/16
1,792,082 2/1931 Fink et al. ..... 428/667
2,767,464 10/1956 Nack et al. ..... 428/679

FOREIGN PATENT DOCUMENTS 743111 1/1956 United Kingdom ..... 42/76 A

OTHER PUBLICATIONS

William T. Ebihara, Wear and Erosion Characteristics of a Cast Cobalt Base Alloy, AD-759 125, Jan. 1973, pp. 1-16.

Lamb et al., Ordnance, "Plating Gun Bores," Mar.-Apr. 1961, pp. 725-727.

*Primary Examiner*—Stephen C. Bentley

*Attorney, Agent, or Firm*—Bacon & Thomas

[57] ABSTRACT

This barrel is characterized in that it comprises three layers superimposed without any break in continuity of surface contact between layers, namely: an internal layer of a refractory material; a core layer of a material the mechanical strength of which is higher than about 250 MPa at 900° and an external layer of an alloyed steel. The invention relates also to a process for the manufacture of such barrel.

1 Claim, 2 Drawing Figures

COMPOSITE BARREL AND PROCESS FOR THE MANUFACTURE THEREOF

BACKGROUND OF THE INVENTION

This invention relates to a composite barrel and to a process for the manufacture thereof, said barrel being more particularly intended for automatic weapons.

Automatic weapons are mechanisms the sub-assemblies and the constituting parts of which are subjected to severe operating stresses. This is particularly the case for barrels and especially for barrels of weapons used at very high rates of fire such as the barrels of machine-guns. In that case, the metal of the barrel is mechanically stressed while being maintained at a very high temperature and in any case higher than 500° C. This temperature rise results from the combustion of the propelling powder and from friction. The available energy is principally used for moving the projectile, but a substantial fraction of said energy is converted into heat radiating outwardly through the metal of the barrel which strongly warms up. In fact, the involved stresses may be resumed as follows:

- the erosion and the corrosion through the combustion gases of the propelling powder;
- the thermal fatigue resulting from the repeated mechanical stresses at a high temperature;
- the friction resulting from the passage of the projectile which, starting from a zero speed, reaches a speed of several hundreds of m/sec. within one millisecond;
- an internal pressure of several thousands of bars inducing, in the barrel, mechanical stresses which are substantial, but of short duration.

These phenomenons are well known by those skilled in the art who tried, through various means, to find solutions to this complex problem. In fact, although the alloyed steels (materials generally used for manufacturing barrels) do allow a perfect operation of the weapons at relatively slow rates of fire, they do not make it possible to obtain high rates of fire for a substantial time interval. Accordingly, the life of a barrel made of steel and used at high rates of fire is relatively short. Thus, it may be said that it is really necessary to provide a barrel allowing high rates of fire with an acceptable useful life under such conditions. In fact, such barrel should have the following characteristics:

- a high mechanical strength at room temperature and at 900° C.;
- a good resilience down to −60° C.;
- a small friction coefficient relative to the materials used as projectile coatings even at temperatures of about 1000° C.;
- a substantial resistance to the corrosion caused by the combustion gases of the propelling powders;
- a low tendency to the thermal fatigue;
- a substantial thermal conductivity;
- a good formability by means of conventional equipments allowing the internal rifling and the external machining without major difficulties.

SUMMARY OF THE INVENTION

The object of this invention is to provide such barrel. According to the invention, said barrel comprises three layers superimposed without any break in continuity of surface contact between layers, namely: an internal layer of a refractory material; a core layer of a material the mechanical strength of which is higher than about 250 MPa at 900° C., and an external layer of an alloyed steel.

Examples of materials suitable for making such barrel are:

- for the internal layer: chromium, tungsten, niobium, tungsten carbide and the like or alloys thereof;
- for the core layer: cobalt alloys such as those used for turbo-jets;
- for the external layer: alloyed steels, e.g. chromium-molybdenum alloys allowing a relatively easy machining.

The absence of any break in continuity is essential, otherwise hot spots leading to premature destructions would exist. Tests have shown that tubular layers superimposed by hooping or mechanical assembling presented thickness discontinuities in spite of all the precautions taken to prevent them. Now, a thickness discontinuity lower than 0.01 mm is sufficient for generating a hot spot, thereby leading to a premature destruction.

According to this invention, a satisfactory process comprises threading three tubes each intended to form one of the above-mentioned layers, and then co-hammering them on a mandrel until any solution of continuity between the said tubes is removed.

The absence of any break in continuity may be readily checked up by microscope examination of longitudinal or radial sections of the barrel. However, this destructive method does not apply to the manufacture control. In that case, the examinations are carried out by radiography or radioscopy or still by ultrasonic techniques.

Since the internal layer may be relatively thin in consideration of its raison d'etre, i.e. it may have a thickness lower than 1 mm, another embodiment of the process according to the invention comprises co-hammering the external layer and the core layer, then forming the internal layer by cementation, gaseous phase deposition, vacuum vaporization or electrodeposition, all the precautions being taken to obtain a perfect adherence, i.e. to prevent any break in continuity.

Whatever the adopted method may be, a grooved mandrel will be advantageously used for co-hammering, which allows to obtain a rifled blank while thereby reducing the manufacturing costs.

DESCRIPTION OF THE PREFERRED EMBODIMENT

Figure 1:
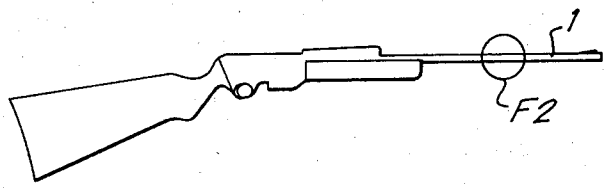
FIG. 1 is a view of a gun incorporating the present invention.
Figure 2:
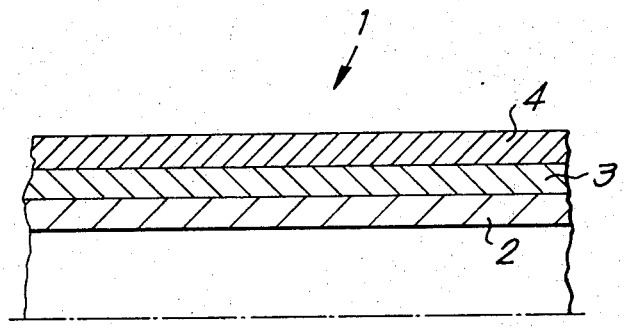
FIG. 2 is an enlarged fragmentary sectional view of a portion of the barrel of the gun of FIG. 1.

As shown in the drawing of FIG. 1, the gun has a barrel 1 shown in greater detail in FIG. 2 which is an enlarged fragmentary sectional view of a portion of the barrel of FIG. 1 as seen within the circle F2. As shown in FIG. 2, the barrel consists of an inner layer 2, an intermediate or strengthening layer 3 and an outer layer 4.

The following example may be given for illustrating the invention without however restricting it to a single case: a 7.62 mm machine-gun barrel has been obtained by co-hammering two tubes the internal tube of which is made of a cobalt alloy similar to those used in the construction of turbo-jets, while the external tube is made of a Cr-Mo alloyed steel.

The operation has been carried out on a grooved mandrel of a hard material, thereby providing a rifled barrel blank. Owing to a judicious selection of the hammering parameters, the obtained composite product was free from any break in continuity. The bore of the blank was then chromiumplated under conditions likely to give a perfectly adhering coating. After machining the external surface of the blank, the obtained barrel was subjected to a resistance fire and compared with a barrel completely similar as regards its dimensions, but completely made of the same Cr-Mo alloyed steel as that used for the external layer of the composite product. A chromium internal coating had been deposited on said barrel through a conventional technique.

The test has shown that the composite barrel had a useful life three times longer as that of the conventional barrel, as determined on the basis of a criterion of fire precision.

I claim:

1. A composite gun barrel comprising an internal layer made from the group of metals consisting of tungsten, niobium, tungsten carbide and alloys thereof an intermediate layer made of a cobalt alloy and an external layer made of an alloyed steel.

* * * * *